US012623701B2

(12) United States Patent
Piparsaniya

(10) Patent No.: US 12,623,701 B2
(45) Date of Patent: May 12, 2026

(54) AUTOMATIC ARMING OF A HEAD-OF-TRAIN DEVICE TO AN END-OF-TRAIN DEVICE

(71) Applicant: Siemens Mobility, Inc., New York, NY (US)

(72) Inventor: Harsh Piparsaniya, Pune (IN)

(73) Assignee: SIEMENS MOBILITY, INC., New York, NY (US)

( * ) Notice: Subject to any disclaimer, the term of this patent is extended or adjusted under 35 U.S.C. 154(b) by 980 days.

(21) Appl. No.: 17/745,973

(22) Filed: May 17, 2022

(65) Prior Publication Data

US 2022/0379936 A1 Dec. 1, 2022

(30) Foreign Application Priority Data

May 28, 2021 (IN) ..... 202141023791

(51) Int. Cl.
*B61L 15/00* (2006.01)

(52) U.S. Cl.
CPC ..... *B61L 15/0063* (2013.01); *B61L 15/0072* (2013.01)

(58) Field of Classification Search
CPC ..... B61L 15/0063; B61L 15/0072; B61L 15/0027; B61L 15/0054
See application file for complete search history.

(56) References Cited

U.S. PATENT DOCUMENTS

| | | | | |
|---|---|---|---|---|
| 5,016,840 | A * | 5/1991 | Bezos | B60T 17/228 246/167 R |
| 7,096,096 | B2 * | 8/2006 | Kane | B61L 27/40 701/19 |
| 7,872,591 | B2 * | 1/2011 | Kane | B61L 15/0054 340/902 |
| 9,393,977 | B2 * | 7/2016 | Kramer | B61L 27/57 |
| 9,902,412 | B2 * | 2/2018 | Fernandes | B60T 8/1705 |
| 9,994,242 | B2 * | 6/2018 | Bartek | B61L 15/0072 |
| 10,173,702 | B2 * | 1/2019 | Huchrowski | B61L 15/0081 |
| 11,001,284 | B2 * | 5/2021 | Abrosimov | B61L 25/04 |
| 11,858,542 | B2 * | 1/2024 | Corvari | H02J 7/14 |

(Continued)

FOREIGN PATENT DOCUMENTS

| | | | | |
|---|---|---|---|---|
| AU | 2015327901 | A1 * | 4/2017 | B61L 15/0027 |
| CA | 3128801 | C * | 4/2024 | |

*Primary Examiner* — Jason C Smith
(74) *Attorney, Agent, or Firm* — Schmeiser, Olsen & Watts LLP

(57) ABSTRACT

A system and method for enabling automatic arming between an End-of-Train device and a Head-of-Train device on a train is provided. The system includes at least one sensing unit configured to detect a physical connection status of the End-of-Train device. The End-of-Train device is configured to transmit an arming request to the Head-of-Train device based on the physical connection status, wherein the arming request includes at least one of an identifier and a geospatial location associated with the End-of-Train device. The Head-of-Train device is configured to receive the arming request from the End-of-Train device. The Head-of-Train device is further configured to arm the Head-of-Train device to the End-of-Train device upon verification of the arming request, wherein arming comprises establishing a communication channel between the Head-of-Train device and the End-of-Train device.

12 Claims, 4 Drawing Sheets

(56) References Cited

U.S. PATENT DOCUMENTS

| | | | | |
|---|---|---|---|---|
| 11,956,577 | B2 * | 4/2024 | Piparsaniya | H04Q 9/00 |
| 11,999,391 | B2 * | 6/2024 | Piparsaniya | B61L 25/025 |
| 2005/0004722 | A1 * | 1/2005 | Kane | B61L 15/0054 701/19 |
| 2008/0149781 | A1 * | 6/2008 | Root | B60T 17/228 246/167 R |
| 2010/0130124 | A1 * | 5/2010 | Teeter | B61L 15/0027 455/15 |
| 2010/0213321 | A1 * | 8/2010 | Kane | B61L 25/025 246/167 R |
| 2016/0096537 | A1 * | 4/2016 | Bartek | B61L 15/0027 246/124 |
| 2020/0122757 | A1 * | 4/2020 | Abrosimov | B61L 15/0018 |
| 2022/0194443 | A1 * | 6/2022 | Covari | H02J 7/14 |
| 2022/0266878 | A1 * | 8/2022 | Piparsaniya | B61L 15/02 |
| 2022/0281496 | A1 * | 9/2022 | Fernandes | B61L 15/0054 |
| 2022/0379936 | A1 * | 12/2022 | Piparsaniya | B61L 15/0063 |
| 2023/0063525 | A1 * | 3/2023 | Fernandes | B61L 15/0027 |
| 2023/0066917 | A1 * | 3/2023 | Piparsaniya | B61L 23/00 |
| 2023/0202538 | A1 * | 6/2023 | Fernandes | B61L 15/0027 246/167 R |
| 2024/0067242 | A1 * | 2/2024 | Piparsaniya | B61L 25/025 |

* cited by examiner

AUTOMATIC ARMING OF A HEAD-OF-TRAIN DEVICE TO AN END-OF-TRAIN DEVICE

CROSS-REFERENCE TO RELATED APPLICATIONS

This application claims priority to Indian Application No. 202141023791, having a filing date of May 28, 2021, the entire contents of which are hereby incorporated by reference.

FIELD OF TECHNOLOGY

The following relates to End-of-Train Telemetry systems, and more particularly relates to systems and methods for enabling automatic arming between a Head-of-Train device and an End-of-Train device on a train.

BACKGROUND

An End-of-Train Telemetry system comprises a Head-of-Train device mounted inside a driver's cab of a train and an End-of-Train device mounted at the rear end of the train. The Head-of-Train device is configured to communicate with the End-of-Train device through Radio-Frequency communication. The process of establishing a telemetry link between the Head-of-Train device and the End-of-Train device is commonly known as arming. The arming operation involves exchange of test messages between the Head-of-Train device and the End-of-Train device to establish the telemetry link.

Arming typically requires manual efforts. Firstly, a railway personal has to ensure that the End-of-Train device is connected properly. For example, the railway personnel has to monitor a coupling of the End-of-Train device to the train, a hose connection associated with the End-of-Train device, brake line pressure etc. Upon receiving a confirmation from the railway personnel on the status of the End-of-Train device, a driver of the train actuates a switch on the Head-of-Train device to initiate the arming operation. Therefore, the process of arming requires manual coordination. Consequently, initiating the arming operation everytime the train starts operation, can be tedious and time-consuming.

In light of the above, there is a need for a system and method for enabling automatic arming of a Head-of-Train device to an End-of-Train device on a train, in order to reduce manual efforts involved in arming.

SUMMARY

An aspect relates to a system and method for enabling automatic arming of a Head-of-Train device to an End-of-Train device. In an embodiment, a system for enabling automatic arming between an End-of-Train device and a Head-of-Train device on a train is disclosed. The system comprises at least one sensing unit configured to detect a physical connection status of the End-of-Train device. In an embodiment, the at least one sensor comprises at least one of a camera, an accelerometer and a pressure sensor. The End-of-Train device is configured to transmit an arming request to the Head-of-Train device based on the physical connection status. In an embodiment, the arming request comprises at least one of an identifier and a geospatial location associated with the End-of-Train device. The Head-of-Train device is configured to receive the arming request from the End-of-Train device. The Head-of-Train device is further configured to arm the Head-of-Train device to the End-of-Train device upon verification of the arming request, wherein arming comprises establishing a communication channel between the Head-of-Train device and the End-of-Train device.

In an embodiment, the Head-of-Train device is further configured to verify the arming request locally based on at least one of the geospatial location of the End-of-Train device, a length of the train, an output of the at least one sensing unit and a Received Signal Strength Indicator associated with the arming request. In another embodiment, the Head-of-Train device is communicatively coupled to a remote server, and the Head-of-Train device is configured to generate a verification request based on the arming request. Further, the Head-of-Train device generates a verification request based on the arming request. The Head-of-Train device further transmits the verification request to the remote server. The remote server is configured to receive the verification request from the Head-of-Train device. The remote server further verifies the arming request based on a predefined logic upon receiving the verification request. Further, the remote server further transmits a response comprising an outcome of the verification to the Head-of-Train device.

In an embodiment, a method for enabling automatic arming of a Head-of-Train device to an End-of-Train device on a train is disclosed. The method comprises receiving, by the Head-of-Train device, an arming request from the End-of-Train device, wherein the arming request comprises at least one of an identifier and a geospatial location associated with the End-of-Train device. In an embodiment, the arming request is generated by the End-of-Train device based on a physical connection status of the End-of-Train device. The method further comprises arming the Head-of-Train device to the End-of-Train upon verification of the arming request, wherein arming comprises establishing a communication channel between the Head-of-Train device and the End-of-Train device.

BRIEF DESCRIPTION

Some of the embodiments will be described in detail, with reference to the following figures, wherein like designations denote like members, wherein.

DETAILED DESCRIPTION

Figure 1:
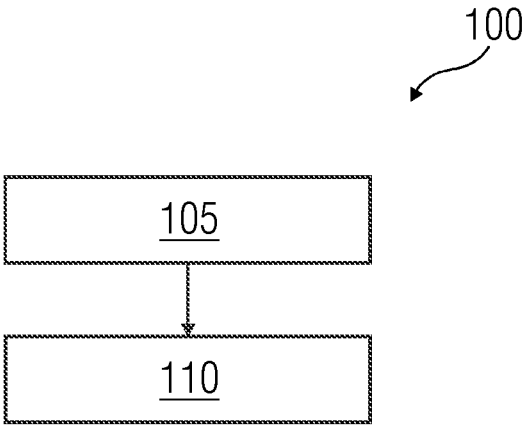
FIG. 1 shows an exemplary method of automatically arming a Head-of-Train device to and an End-of-Train device in accordance with an embodiment of the present disclosure.

Hereinafter, embodiments for carrying out the present invention are described in detail. The various embodiments are described with reference to the drawings, wherein like reference numerals are used to refer to like elements throughout. In the following description, for purpose of explanation, numerous specific details are set forth in order to provide a thorough understanding of one or more embodiments. It may be evident that such embodiments may be practiced without these specific details.

FIG. 1 shows an exemplary method 100 of automatically arming a Head-of-Train device to and an End-of-Train device in accordance with an embodiment of the present disclosure.

At step 105, the Head-of-Train device receives an arming request from the End-of-Train device. The arming request comprises at least one of an identifier and a geospatial location associated with the End-of-Train device.

At step 110, the Head-of-Train device arms the Head-of-Train device to the End-of-Train upon verification of the arming request. Arming of the Head-of-Train device to the End-of-Train device comprises establishing a communication channel between the Head-of-Train device and the End-of-Train device. In an embodiment, the arming request is verified locally at the Head-of-Train device as explained with reference to FIG. 2. In another embodiment, the arming request is verified by a remote server as explained with reference to FIG. 3. Upon arming, the End-of-Train device and the Head-of-Train device may coordinate with each other to perform functions related to emergency braking, function and health of the End-of-Train device, functioning of the High Visibility Marker etc.

Figure 2:
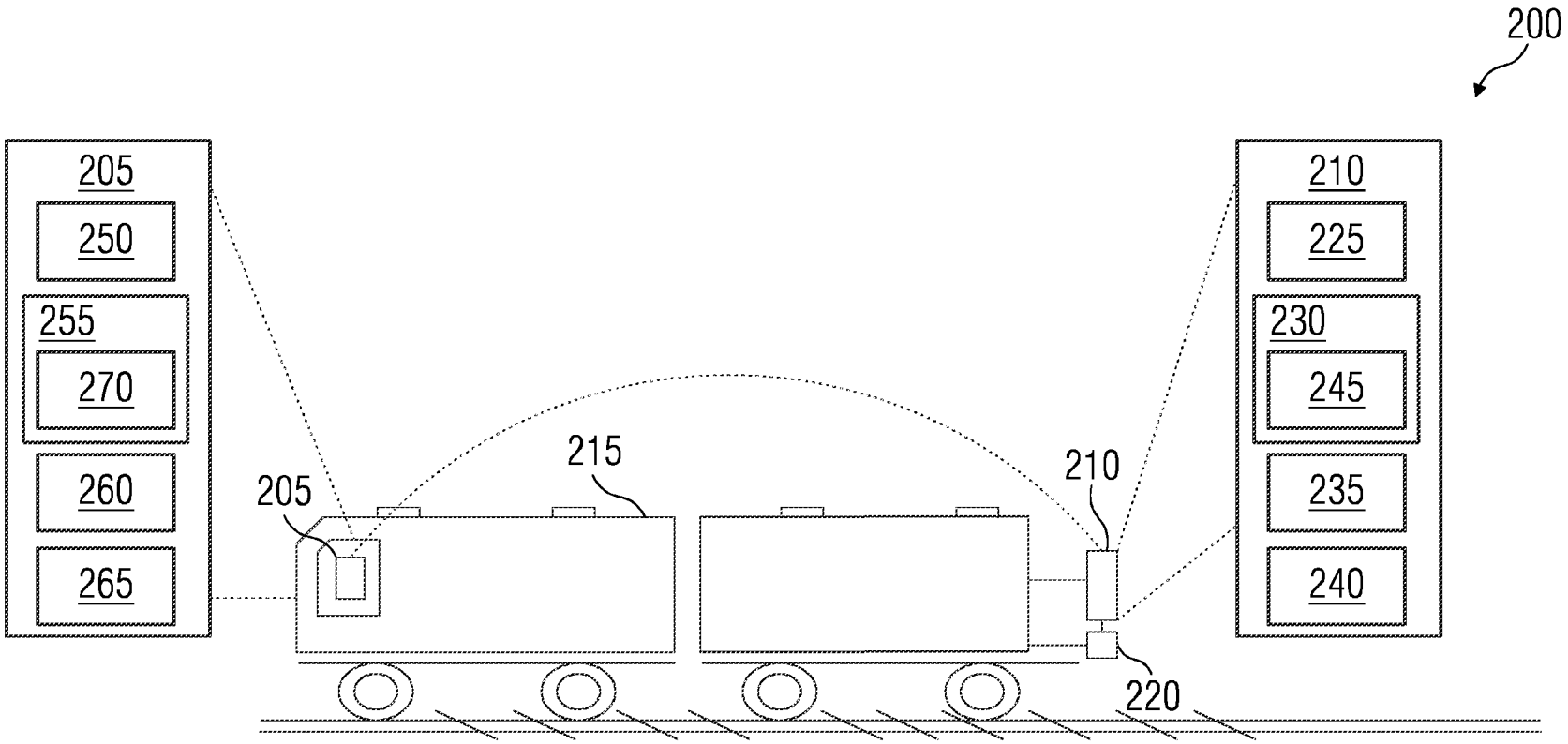
FIG. 2 illustrates a system for enabling automatic arming between a Head-of-Train device and an End-of-Train device on a train, in accordance with an exemplary embodiment of the present disclosure.

FIG. 2 illustrates a system 200 for enabling automatic arming between a Head-of-Train device 205 and an End-of-Train device 210 on a train 215, in accordance with an exemplary embodiment of the present disclosure. In addition to the End-of-Train device 210 and the Head-of-Train device 205, the system 200 comprises at least one sensing unit 220. The sensing unit 220 may be mounted as a separate entity at a rear end of the train 215 or may be part of the End-of-Train device 210.

The sensing unit 220 includes at least one of a camera (not shown) and a pressure sensor (not shown). In an embodiment, the camera is an embedded camera provided on an enclosure of the End-of-Train device 210. In another embodiment, the camera is mounted near a clamp (not shown) used for mounting the End-of-Train device 210 onto the train 215. The camera is further communicatively coupled to the End-of-Train device 210. The camera is configured to detect whether the End-of-Train device 210 is mounted on the train 215. In an example, the End-of-Train device 210 may comprise accelerometers that detect a movement of the End-of-Train device 210. For example, mounting of the End-of-Train device 210 may include lifting off the ground and coupling to a coupler provided on the train 215. The accelerometers may detect if the End-of-Train device 210 is unmounted or mounted on the train 215, based on tilt or jerks occurring during the mounting or unmounting action. Further, an output of the accelerometer may be used to trigger operation of the camera.

Upon triggering, the camera may capture images associated with the clamp. Further, the camera may also capture an image associated with a pressure hose connection to the End-of-Train device 210. The camera may further process the images to detect a physical connection status of the End-of-Train device 210. The term 'physical connection status' as used herein, refers to a physical coupling of the End-of-Train device 210 to the train 215. More specifically, the images indicate a placement of the End-of-Train device 210 on the clamp and also whether the hose is connected or disconnected from the End-of-Train device 210. In another embodiment, the camera transmits the images to the End-of-Train device 210 for enabling the End-of-Train device 210 to detect the physical connection status. Similarly, the pressure sensor may detect the physical connection status of the End-of-Train device 210 based on a measured value of the brake line pressure. In one embodiment, the End-of-Train device 210 may house the pressure sensor.

The End-of-Train device 210 includes an air generator (not shown) that powers the End-of-Train device 210 using air pressure from the brake line. In an embodiment, the physical connection status may be determined based on outputs of the sensing unit 220, in conjunction with a voltage output from the air generator, using a predefined logic. For example, when the End-of-Train device 210 is connected to the brake line, the air generator starts operating, resulting in a voltage at the output of the air generator. The voltage output indicates that the electrical generator has started to function and the End-of-Train device 210 is successfully connected. In an embodiment, the sensing unit 220 detects the physical connection status based on outputs from the camera, the pressure sensor and the voltage output from the air generator.

The End-of-Train device 210 comprises a first processing unit 225, a first memory 230, a first Global Navigation Satellite System (GNSS) receiver 235 and a first communication unit 240. The first processing unit 225 includes any type of computational circuit, such as, but not limited to, a microprocessor, a microcontroller, a complex instruction set computing microprocessor, a reduced instruction set computing microprocessor, a very long instruction word microprocessor, an explicitly parallel instruction computing microprocessor or any other type of processing circuit. The first processing unit 225 may also include embedded controllers, such as generic or programmable logic devices or arrays, application specific integrated circuits, single-chip computers, and the like. In general, the first processing unit 225 may comprise hardware elements and software elements. The first processing unit 225 can be configured for multithreading, i.e., the first processing unit 225 may host different calculation processes at the same time, executing the either in parallel or switching between active and passive calculation processes.

The first memory 230 may include one or more of a volatile memory and a non-volatile memory. The first memory 230 may be coupled for communication with the first processing unit 225. The first processing unit 225 may execute instructions and/or code stored in the first memory 230. A variety of computer-readable storage media may be stored in and accessed from the first memory 230. The first memory 230 may include any suitable element for storing data and machine-readable instructions, such as read only memory, random access memory, erasable programmable read only memory, electrically erasable programmable read only memory, hard drive, removable media drive for handling compact disks, digital video disks, diskettes, magnetic tape cartridges, memory cards, and the like.

The first memory 230 comprises a request generation module 245 that is stored in the form of machine-readable instructions for execution by the first processing unit 225. The first memory 230 also stores a unique identifier associated with the End-of-Train device 210. These machine-readable instructions when executed causes the first processing unit 225 to generate an arming request based on the physical connection status determined by the sensing unit 220.

The first GNSS receiver 235 enables the End-of-Train device 210 to receive GNSS data from a plurality of GNSS satellites. Based on the GNSS data, the first processing unit 225 determines a geospatial location of the End-of-Train device 210. The term 'geospatial location' as used herein, refers to a geographical coordinates computed based on data received from GNSS satellites. Non-limiting examples of GNSS include, Global Positioning System (GPS), Galileo, GLONASS and BeiDou. The first communication unit 240 enables the End-of-Train device 210 to communicate with the Head-of-Train device 205 through Radio-Frequency (RF) Communication.

The Head-of-Train device 205 comprises a second processing unit 250, a second memory 255, a second GNSS receiver 260 and a second communication unit 265. The second processing unit 250 includes any type of computational circuit, such as, but not limited to, a microprocessor, a microcontroller, a complex instruction set computing microprocessor, a reduced instruction set computing microprocessor, a very long instruction word microprocessor, an explicitly parallel instruction computing microprocessor, a graphics processor, a digital signal processor, or any other type of processing circuit.

The second processing unit 250 may also include embedded controllers, such as generic or programmable logic devices or arrays, application specific integrated circuits, single-chip computers, and the like. In general, the second processing unit 250 may comprise hardware elements and software elements. The second processing unit 250 can be configured for multithreading, i.e. the second processing unit 250 may host different calculation processes at the same time, executing the either in parallel or switching between active and passive calculation processes.

The second memory 255 may include one or more of a volatile memory and a non-volatile memory. The second memory 255 may be coupled for communication with the second processing unit 250. The second processing unit 250 may execute instructions and/or code stored in the second memory 255. A variety of computer-readable storage media may be stored in and accessed from the second memory 255. The second memory 255 may include any suitable element for storing data and machine-readable instructions, such as read only memory, random access memory, erasable programmable read only memory, electrically erasable programmable read only memory, hard drive, removable media drive for handling compact disks, digital video disks, diskettes, magnetic tape cartridges, memory cards, and the like.

The second memory 255 comprises a local verification module 270, stored in the form of machine-readable instructions and executable by the second processing unit 250. These machine-readable instructions when executed causes the second processing unit 250 to configured for verifying the arming request from the End-of-Train device 210. The second GNSS receiver 260 enables the Head-of-Train device 205 to receive GNSS data from a plurality of GNSS satellites. Based on the GNSS data, the second processing unit 250 determines a geospatial location of the Head-of-Train device 205. The second communication unit 265 enables the Head-of-Train device 205 to communicate with the End-of-Train device 210 through Radio-Frequency (RF) Communication.

The arming operation is initiated based on a physical connection status of the End-of-Train device 210. More specifically, if the output of the sensing unit 220 indicate that the End-of-Train device 210 is connected, the End-of-Train device 210 generates an arming request. The arming request comprises the geospatial location of the End-of-Train device 210 and a unique identifier associated with the End-of-Train device 210. For example, the geospatial location may comprise a GNSS location of the End-of-Train device 210.

The arming request is further transmitted to the Head-of-Train device 205. The Head-of-Train device 205 further verifies the arming request based on the geospatial location of the End-of-Train device 210 and the unique identifier of the End-of-Train device 210. The term 'verify' as used herein refers to the process of determining whether the Head-of-Train device 205 and the End-of-Train device 210 are on the same train for the purpose of initiating arming. In an embodiment, the arming request may further comprise output from the sensing unit 220. The head-of-Train device may further validate the physical connection status of the End-of-Train device 210 based on the outputs from the sensing units.

In an embodiment, the verification process comprises determining whether the End-of-Train device 210 and the Head-of-Train device 205 are mounted on the same train 215. The arming request is verified successfully if the Head-of-Train device 205 and the End-of-Train device 210 are associated with the same train 215. Otherwise, the arming request is not verified.

In another embodiment, the verification process comprises checking for an integrity of the train 215. For example, if the coaches of the train 215 are not coupled, the distance between the End-of-Train device 210 and the Head-of-Train device 205 is determined to be greater than a length of the train 215. Consequently, the End-of-Train device 210 and Head-of-Train device 205 are not ready for arming and the arming request is not verified. Otherwise, the arming request is verified.

In the present embodiment, the Head-of-Train device 205 verifies the arming request based on a predefined length of the train 215. In an implementation, the arming request is verified by firstly computing a length of the train 215 based on the geospatial location of the End-of-Train device 210 and a geospatial location of the Head-of-Train device 205.

In another embodiment, the Head-of-Train device 205 computes the length of the train 215 based on the received signal strength indicator using a predefined relationship. This is because, the received signal strength indicator is inversely proportional to the length of the train 215.

The Head-of-Train device 205 further compares the predefined length of the train 215 with the computed length of the train 215. If the computed length of the train 215 does not match the predefined length, the verification of the arming request fails. Otherwise, if the computed length matches the predefined length, the verification is successful.

Upon successful verification, the Head-of-Train device 205 initiates an arming operation. In an implementation, the arming operation is initiated by sending an acknowledgement back to the End-of-Train device 210. Further, the Head-of-Train device 205 may complete the arming operation based on a further response of the End-of-Train device 210 to the acknowledgement. In an embodiment, the End-of-Train device 210 may also prompt a driver of the train 215 to perform a dump test before completing the arming operation. The dump test is used to ensure proper air flow in the brake lines and may be initiated, by the driver, by pressing a button provided on the Head-of-Train device 205. During the dump test, the Head-of-Train device 205 may monitor a change in pressure in brake lines associated with the train 215. In another embodiment, the dump test may be initiated by an actuating mechanism provided external to the Head-of-Train device 205.

In an embodiment, an additional level of verification may be required for the arming request from the End-of-Train device 210 in order to ensure that the right pair of Head-of-Train device 205 and End-of-Train device 210 are armed.

In an example, if a first train and a second train are parked on the same track one behind the other, the Head-of-Train device 205 on the first train initiates arming only with the End-of-Train device 210 on the first train and not with the End-of-Train device on the second train. This is because, the Head-of-Train device 205 identifies the respective End-of-Train device for arming based on the length of the train. In another example, if the first train and the second train of same length are parked on parallel rail tracks, it is likely that the Head-of-Train device 205 may initiate arming with End-of-Train device 210 of the train on the parallel track. In order to avoid this a Head-of-Train device may verify the arming request with the help of the remote server as explained using FIG. 3.

Figure 3A:
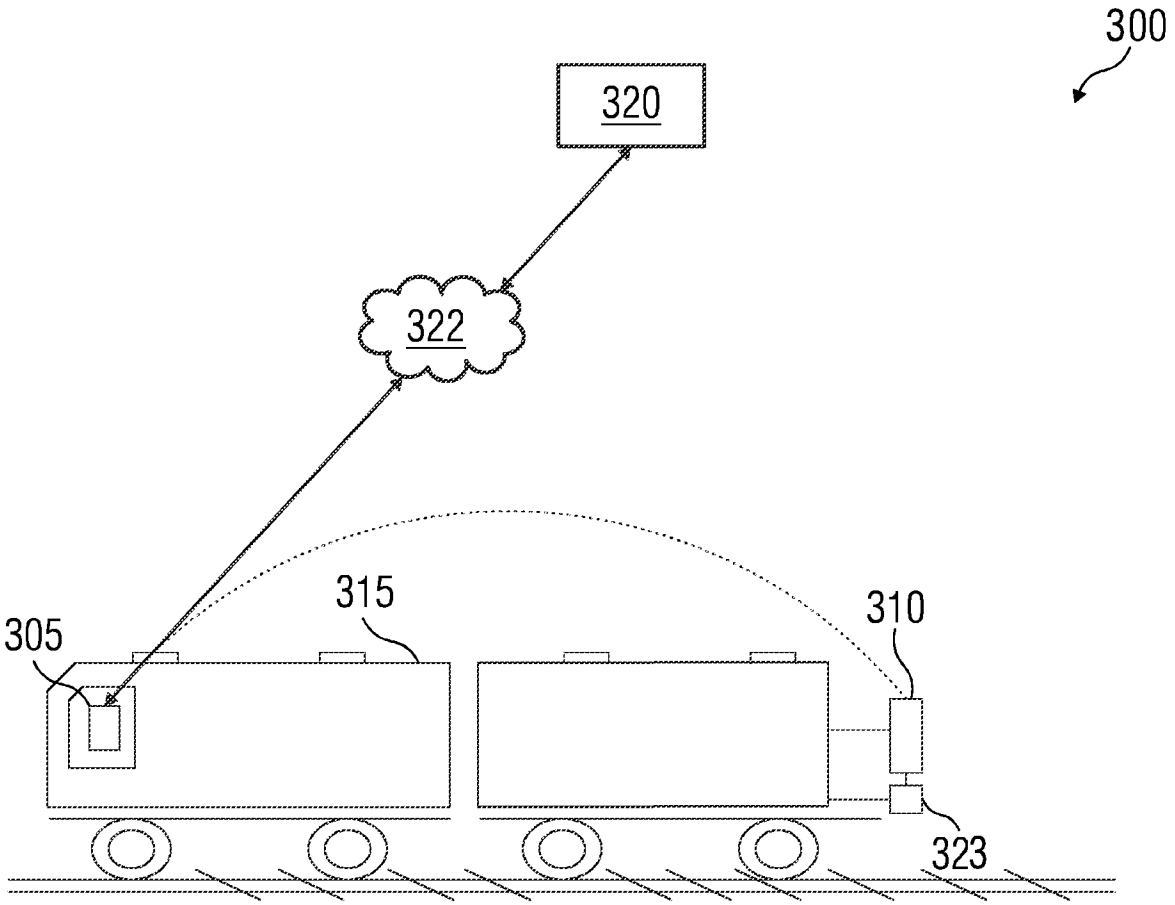
FIG. 3A illustrates a system for enabling automatic arming between a Head-of-Train device and an End-of-Train device on a train, in accordance with another embodiment of the present disclosure.

FIG. 3A illustrates a system 300 for enabling automatic arming between a Head-of-Train device 305 and an End-of-Train device 310 on a train 315 in accordance with another embodiment of the present disclosure. The system 300 comprises a Head-of-Train device 305 (similar to Head-of-Train device 205), an End-of-Train device 310 (similar to End-of-Train device 210) and at least one sensing unit 323 (similar to sensing unit 220). In the present embodiment, the Head-of-Train device 305 is further communicatively coupled to a remote server 320 over a network 322. In an embodiment, the network is a Global System for Mobile Communications (GSM) network.

Figure 3B:
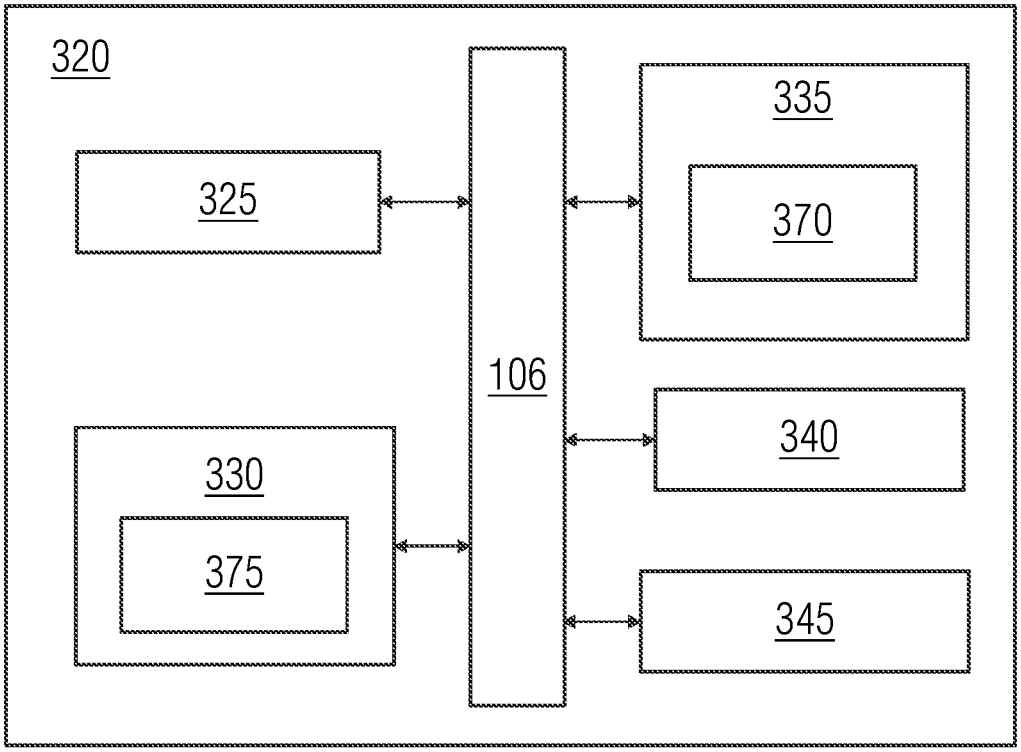
FIG. 3B illustrates a remote server, in accordance with an embodiment of the present disclosure.

The remote server 320 comprises a processing unit 325, a memory 330, a storage unit 335, a communication unit 340, a network interface 345, a standard interface or bus 355 as shown in FIG. 3B. The remote server 320 can be a (personal) computer, a workstation, a virtual machine running on host hardware, a microcontroller, or an integrated circuit. As an alternative, the remote server 320 can be a real or a virtual group of computers (the technical term for a real group of computers is "cluster", the technical term for a virtual group of computers is "cloud").

The storage unit 335 comprises a non-volatile memory which includes a database 370 comprising mappings between Head-of-Train devices and End-of-Train devices. In an implementation, the database 370 may store unique identifiers corresponding to the Head-of-Train devices and End-of-Train devices for every train operating within a geographical territory. In an example, the unique identifiers are assigned to each of the Head-of-Train devices and End-of-Train devices by an Original Equipment Manufacturer. In another example, the unique identifiers are provided based on naming conventions specified by railway authorities. As the Head-of-Train device 305 is fixed permanently to a locomotive, a unique identifier associated with the locomotive may also be used in place of the unique identifier of the Head-of-Train device 305. In yet another example, the unique identifiers corresponding to the Head-of-Train devices 305 and the End-of-Train device 310 may be assigned by a driver of the train. The driver may further update the remote server 320 with the unique identifiers through a client device. In yet another example, the driver or a maintenance personnel may configure the End-of-Train 310 device using a unique identifier associated with the Head-of-Train device 305. Further, the End-of-Train device 310 may update the database 370 by transmitting a message containing the unique identifiers corresponding to the End-of-Train device 310 and the Head-of-Train device 305 to the remote server 320, upon configuration.

The bus 355 acts as interconnect between the processing unit 325, the memory 330, the storage unit 335, and the network interface 345. The output unit may include output means such as displays. The communication unit 340 enables the remote server 320 to communicate with the Head-of-Train device 305. The communication unit 340 may support different standard communication protocols such as Transport Control Protocol/Internet Protocol (TCP/IP) and Internet Protocol Version (IPv).

The processing unit 325 may include any type of computational circuit, such as, but not limited to, a microprocessor, a microcontroller, a complex instruction set computing microprocessor, a reduced instruction set computing microprocessor, a very long instruction word microprocessor, an explicitly parallel instruction computing microprocessor, a graphics processor, a digital signal processor, or any other type of processing circuit. The processing unit 325 may also include embedded controllers, such as generic or programmable logic devices or arrays, application specific integrated circuits, single-chip computers, and the like. In general, the processing unit 325 may comprise hardware elements and software elements. The processing unit 325 can be configured for multithreading, i.e., the processing unit 325 may host different calculation processes at the same time, execut-ing the either in parallel or switching between active and passive calculation processes.

The memory 330 may include one or more of a volatile memory and a non-volatile memory. The memory 330 may be coupled for communication with the processing unit 325. The processing unit 325 may execute instructions and/or code stored in the memory 330. A variety of computer-readable storage media may be stored in and accessed from the memory 330. The memory 330 may include any suitable elements for storing data and machine-readable instructions, such as read only memory, random access memory, erasable programmable read only memory, electrically erasable programmable read only memory, hard drive, removable media drive for handling compact disks, digital video disks, diskettes, magnetic tape cartridges, memory cards, and the like.

The memory 330 comprises a remote verification module 375 configured for verifying an arming request generated by the End-of-Train device 310 based on a verification request received from the Head-of-Train device 305. The remote verification module 375 may be stored in the memory 330 in the form of machine-readable instructions and executable by the processing unit 325. These machine-readable instructions when executed causes the processing unit 325 to verify the arming request.

In the present embodiment, the End-of-Train device 310 generates an arming request comprising a geospatial location and a unique identifier associated with the End-of-Train device 310. The End-of-Train device 310 further transmits the arming request to the Head-of-Train device 305 request. The Head-of-Train device 305 further generates a verification request based on the arming request. More specifically, the verification request comprises the geospatial location of the End-of-Train device 310, the unique identifier of the End-of-Train device 310, a geospatial location of the Head-of-Train device 305, a predefined length of the train 315 and a unique identifier associated with the train 315.

The Head-of-Train device 305 further transmits the verification request to the remote server 320. The remote server 320 further verifies the arming request based on a predefined logic upon receiving the verification request. In an embodiment, the predefined logic is associated with verifying an identity of the End-of-Train device 310 and an integrity of the train 315 based on information present in the verification request.

In an embodiment, the remote server 320 verifies an identity of the End-of-Train device 310 based on the unique identifiers associated with the End-of-Train device 310 and the train 315. More specifically, the remote server 320 verifies from the database 370 whether the End-of-Train device 310 is mapped with to the unique identifier associated with the train 315. Further, the remote server 320 also computes a length of the train 315 based on the geospatial locations of the End-of-Train device 310 and the Head-of-Train device. The computed length is further compared with the predefined length of the train 315 to verify an integrity of the train 315.

The remote server 320 further generates a response comprising an outcome of the verification. In other words, the response indicates a success or failure of the verification. The response comprising the outcome of the verification is further transmitted to the Head-of-Train device 305. If the response indicates successful verification, the Head-of-Train device 305 transmits an acknowledgement to the End-of-Train device 310. Further, the Head-of-Train device 305 prompts the driver of the train 315 to initiate a dump test. If the response indicates unsuccessful verification, the Head-of-Train device 305 may provide a visual indication to notify the driver about the unsuccessful verification. In another embodiment, the dump test may be automatically performed by the Head-of-Train device 305. In case the dump test fails, the Head-of-Train device 305 may prompt the driver of the train 315 to reset the pressure.

In another embodiment, a first level of verification for verifying an integrity of the train 315 may take place at the Head-of-Train device 305 as explained earlier with reference to FIG. 1. Further, a second level of verification for verifying the identity of the End-of-Train device 310 may take place at the remote server 320 as explained above.

Embodiments of the invention facilitate arming between a Head-of-Train device and an End-of-Train device on a train without the need for manual coordination. More specifically, embodiments of the invention automatically identify whether an End-of-Train device is connected to the train, through a sensing unit, thereby manual checking of the physical connection status. Embodiments of the present invention also considers an integrity of the train before arming. Further, embodiments of the present invention is also eliminates chances of falsely arming of the Head-of-Train device with End-of-Train device associated with another train on a parallel track through verification via a remote server.

Embodiments of the present invention are not limited to a particular computer system platform, processing unit, operating system, or network. One or more aspects of embodiments of the present invention may be distributed among one or more computer systems, for example, servers configured to provide one or more services to one or more client computers, or to perform a complete task in a distributed system. For example, one or more aspects of embodiments of the present invention may be performed on a client-server system that comprises components distributed among one or more server systems that perform multiple functions according to various embodiments. These components comprise, for example, executable, intermediate, or interpreted code, which communicate over a network using a communication protocol. Embodiments of the present invention are not limited to be executable on any particular system or group of system, and is not limited to any particular distributed architecture, network, or communication protocol.

Although the present invention has been disclosed in the form of preferred embodiments and variations thereon, it will be understood that numerous additional modifications and variations could be made thereto without departing from the scope of the invention.

For the sake of clarity, it is to be understood that the use of "a" or "an" throughout this application does not exclude a plurality, and "comprising" does not exclude other steps or elements.

The invention claimed is:

1. A system for enabling automatic arming between an End-of-Train device and a Head-of-Train device on a train, the system comprising:

at least one sensing unit configured to:

detect a physical connection status of the End-of-Train device, wherein the physical connection status indicates that the End-of-Train device is physically coupled to the train, wherein the at least one sensing unit comprises a pressure sensor and a camera, and the physical connection status is detected based on outputs from the pressure sensor and the camera in conjunction with a voltage output of a generator of the End-of-Train device;

wherein the End-of-Train device is configured to:

transmit an arming request to the Head-of-Train device based on the physical connection status; and wherein the Head-of-Train device is configured to:

receive the arming request from the End-of-Train device; and arm the Head-of-Train device to the End-of-Train device upon verification of the arming request, wherein arming comprises establishing a communication channel between the Head-of-Train device and the End-of-Train device.

2. The system as claimed in claim 1, wherein the at least one sensing unit further comprises an accelerometer used to trigger an operation of the camera.

3. The system as claimed in claim 1, wherein the arming request comprises at least one of an identifier and a geospatial location associated with the End-of-Train device.

4. The system as claimed in claim 3, wherein the Head-of-Train device is further configured to:

verify the arming request locally based on at least one of the geospatial location of the End-of-Train device, a length of the train, an output of the at least one sensing unit and a Received Signal Strength Indicator associated with the arming request.

5. The system as claimed in claim 1, wherein the Head-of-Train device is communicatively coupled to a remote server, and wherein the Head-of-Train device is configured to:

generate a verification request based on the arming request; and transmit the verification request to the remote server.

6. The system as claimed in claim 5, wherein the remote server is configured to:

receive the verification request comprising the arming request from the Head-of-Train device;

verify the arming request based on a predefined logic upon receiving the verification request; and transmit a response comprising an outcome of the verification to the Head-of-Train device.

7. A method for enabling automatic arming between an End-of-Train device and a Head-of-Train device, the method comprising:

receiving, by the Head-of-Train device, an arming request from the End-of-Train device, wherein the arming request is generated by the End-of-Train device based on a physical connection status of the End-of-Train device detected using at least one sensing unit, wherein the physical connection status indicates that the End-of-Train device is physically coupled to the train, wherein the at least one sensing unit comprises a pressure sensor and a camera, and the physical connection status is detected based on outputs from the pressure sensor and the camera in conjunction with a voltage output of a generator of the End-of-Train device; and arming the Head-of-Train device to the End-of-Train upon verification of the arming request, wherein arming comprises establishing a communication channel between the Head-of-Train device and the End-of-Train device.

8. The method as claimed in claim 7, wherein the arming request comprises at least one of an identifier and a geospatial location associated with the End-of-Train device.

9. The method as claimed in claim 8, further comprising:

verifying the arming request locally, by the Head-of-Train device, based on at least one of the geospatial location of the End-of-Train device, a length of the train and a Received Signal Strength Indicator associated with the arming request.

10. The method as claimed in claim 7, further comprising:

generating a verification request based on the arming request; and transmitting the verification request to a remote server.

11. The method as claimed in claim 10, wherein the remote server verifies the arming request based on a predefined logic upon receiving the verification request.

12. The method as claimed in claim 11, further comprising:

receiving, by the Head-of-Train device, a response comprising an outcome of the verification.

* * * * *